United States Patent [19]

Luevano

[11] Patent Number: 4,624,016

[45] Date of Patent: Nov. 25, 1986

[54] ATHLETIC GLOVE WITH BUILT-IN CUSHIONING

[76] Inventor: Freddie D. Luevano, 2542 N. Delta St., Rosemead, Calif. 91770

[21] Appl. No.: 654,656

[22] Filed: Sep. 26, 1984

[51] Int. Cl.[4] ..... A41D 13/10; A63B 71/14

[52] U.S. Cl. ..... 2/161 A; 2/19; 2/20

[58] Field of Search ..... 2/19, 20, 159, 161 R, 2/161 A

[56] References Cited

U.S. PATENT DOCUMENTS

| | | | |
|---|---|---|---|
| 325,968 | 9/1885 | Rawlings | 2/19 |
| 1,797,116 | 3/1931 | Barden | 2/19 |
| 4,071,913 | 2/1978 | Rector | 2/161 A |

FOREIGN PATENT DOCUMENTS

| | | | |
|---|---|---|---|
| 2546346 | 4/1977 | Fed. Rep. of Germany | 2/161 A |

*Primary Examiner*—Louis K. Rimrodt

*Attorney, Agent, or Firm*—Romney Golant Martin Seldon & Ashen

[57] ABSTRACT

An athletic glove having a laminated cushion partially covering the underside of the hand. Two leather-like sheets are attached together with a thicker cushion layer sandwiched therebetween. The cushion layer is sized and shaped to completely cover the central portion of the palm of the hand and to partially cover the ball of the thumb, the heel of the hand, and the interdigital pads opposite the basal finger knuckles without extending all the way to the basal thumb crease line, the wrist crease line, and the basal finger crease lines in order to provide protection without interfering with the flexing of the hand, thumb and fingers. One of the leather-like sheets has an enlarged cross-sectional area and serves as an external cover member for snugly overlying the entire underside of the hand.

4 Claims, 5 Drawing Figures

ATHLETIC GLOVE WITH BUILT-IN CUSHIONING

This invention relates generally to gloves worn by athletes, and more specifically to gloves worn by athletes during their participation in order to provide protection and to improve their performance.

BACKGROUND OF THE INVENTION

The use of gloves by athletes to protect their hands while at the same time improving their performance has become commonplace. This is particularly true in sports which require the athlete to grip a hitting device such as a bat, racquet, mallet, stick or the like as well as sports or games which require the athlete to catch something with their hand(s).

Unfortunately, most gloves are extremely specialized and serve only limited purposes. For example, in baseball the persons in the field wear bulky oversized mitts while those who are batting often wear thin, tight-fitting gloves to enhance their grip on the bat.

Accordingly, it is an object of the present invention to provide a multipurpose athletic glove which will fit snugly on the hand while at the same time providing protection to the hand against stress, pain and/or injury. Moreover, a related object is to eliminate any fear or anxiety in the mind of the athlete so that better concentration can be accomplished without interfering with the gripping and flexing capabilities of the thumb and fingers as well as the entire hand itself.

Another object is to provide a laminated cushion for the palm of the hand which is part of the glove itself, and to extend a thickened portion of the cushion to at least partially cover the ball of the thumb, the heel of the hand, and the interdigital pads near the base of the fingers.

A related object is to provide an external cover member in the glove which completely covers the underside of the hand constitutes one layer of the laminated cushion, an internal cover member which directly contacts an underside portion of the hand, and a thickened layer therebetween which is sized and shaped to have its outer edges displaced from the basal creases of the thumb, fingers and wrist in order to avoid any interference with the flexing of the thumb, fingers and wrist during the athletic event.

A further object is to provide a multipurpose glove which can be used in different sporting events, thereby eliminated the need to have a separate glove to be used with each different sport. A more specific object is to provide a multipurpose glove which can be used by baseball players during batting, base running, and also inside the mitts during fielding.

These and other objects will be evident to those skilled in the art, and in view of the detailed disclosure of an exemplary embodiment of the invention as more fully set forth in the drawings and written description hereinafter.

DETAILED DESCRIPTION OF EXEMPLARY EMBODIMENT

Figure 1:
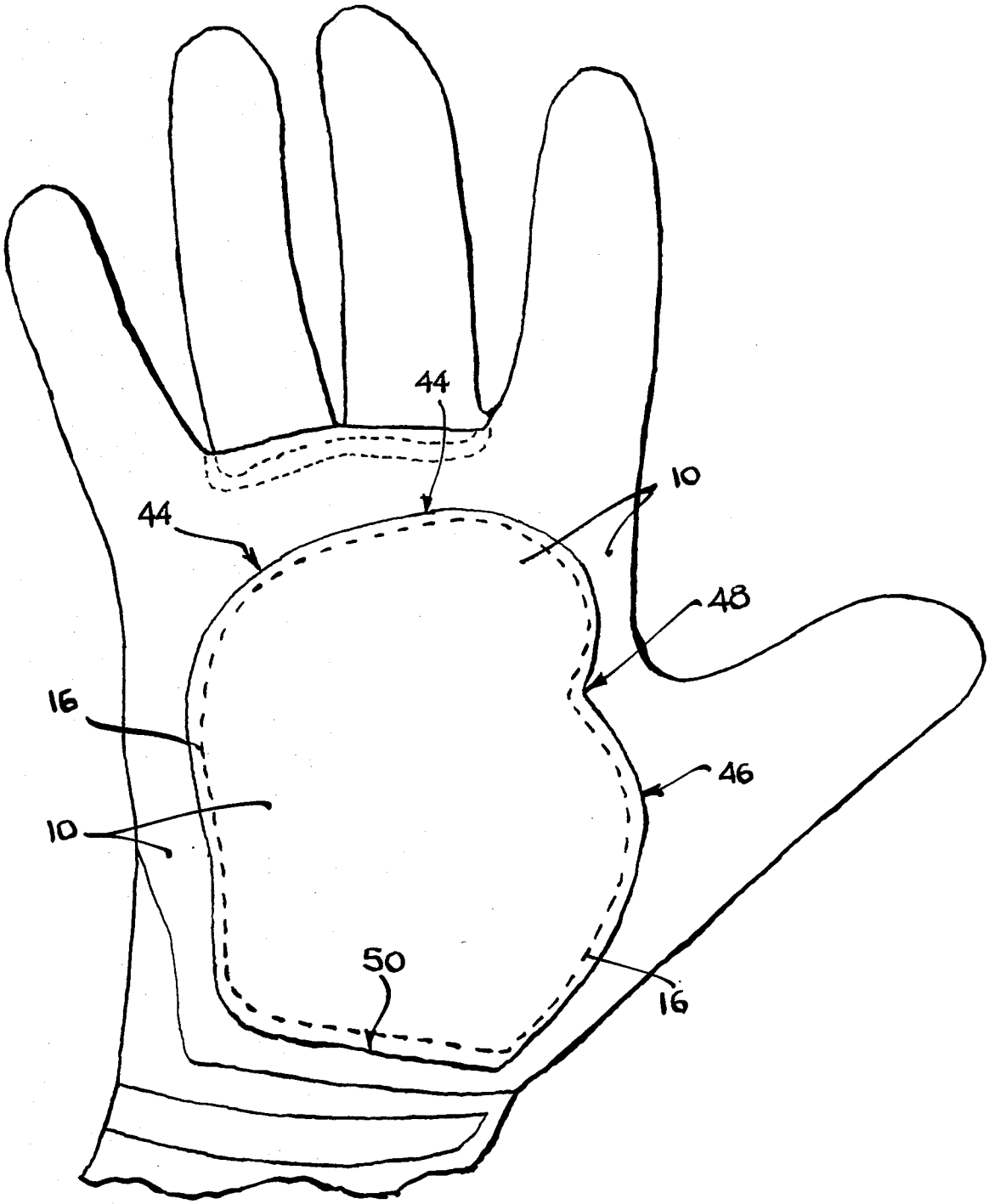
FIG. 1 is a view of a glove incorporating a presently preferred embodiment of the invention, with the underside of a right hand wearing the glove shown in open position.

Generally speaking, the invention provides an improved glove for persons to wear while they are participating in athletic events. The underside of the hand has unique anatomical features which make it difficult to design a glove which protects the hand while at the same time allowing full flexing of the thumb, fingers and wrist. In that regard, the invention in its presently preferred form is shown in the drawings and includes a first leather-like sheet which forms an external cover 10 shaped for snugly overlying the entire underside of the hand, a second leather-like sheet which forms an internal cover 12 which directly contacts the palm of the hand, and a cushion layer 14 of suitable material preferably having a thickness of between $\frac{1}{4}$ inch to $\frac{1}{8}$ inch. Although the thickness may vary, in the presently preferred embodiment the cushion layer has substantially the same thickness throughout.

Figure 2:
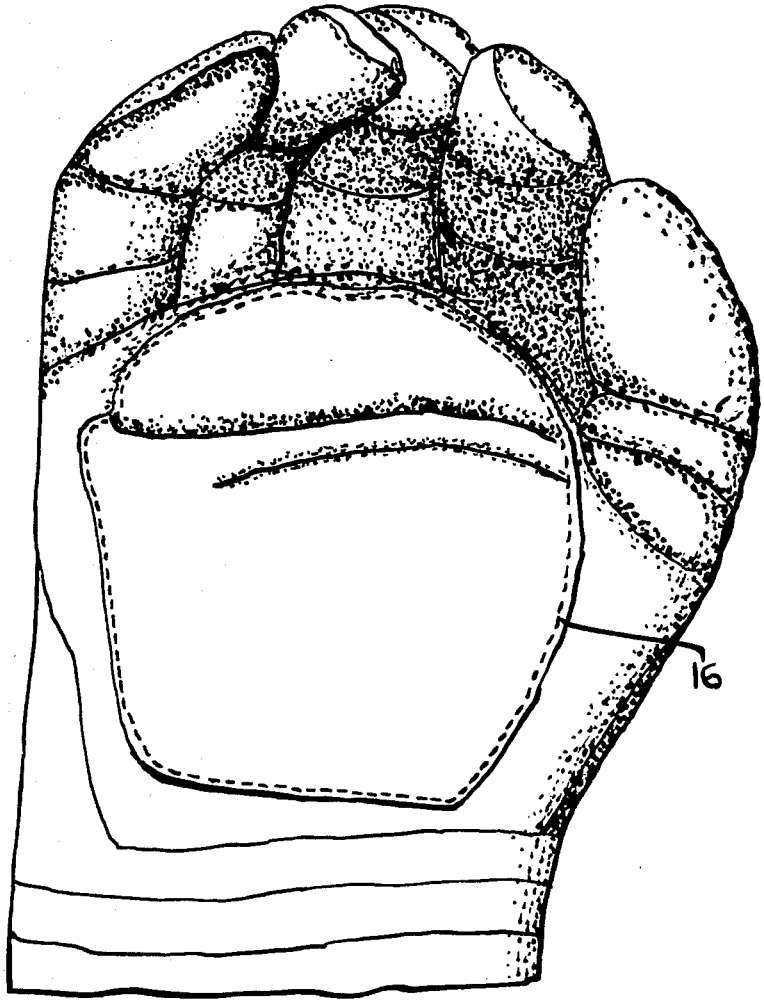
FIG. 2 is a view of the embodiment of FIG. 1, with the underside of the right hand shown in flexed gripping position.
Figure 3:
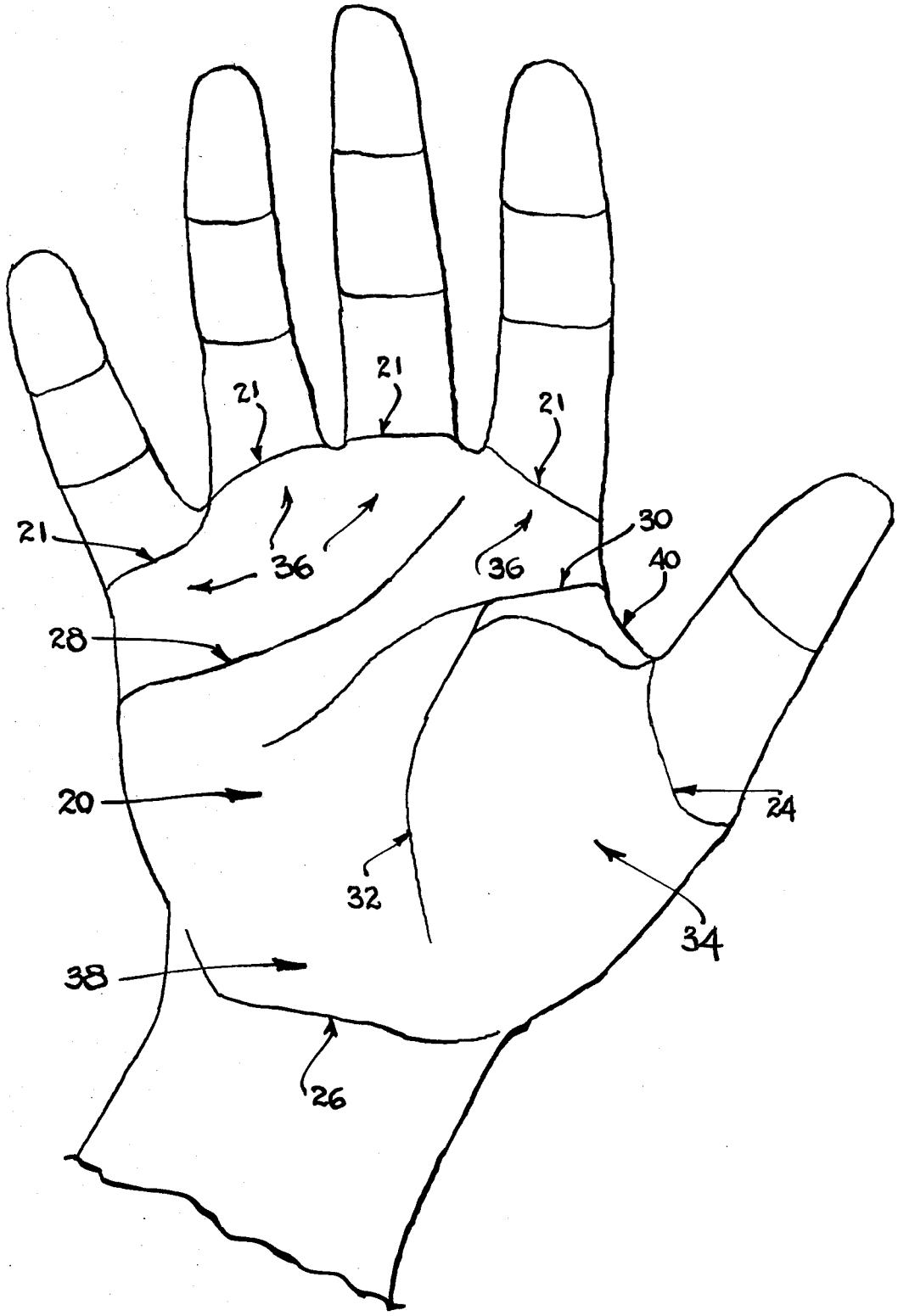
FIG. 3 is a view of the underside of a bare right hand showing the designations of the various portions of the palm, pads and joint creases.
Figure 4:
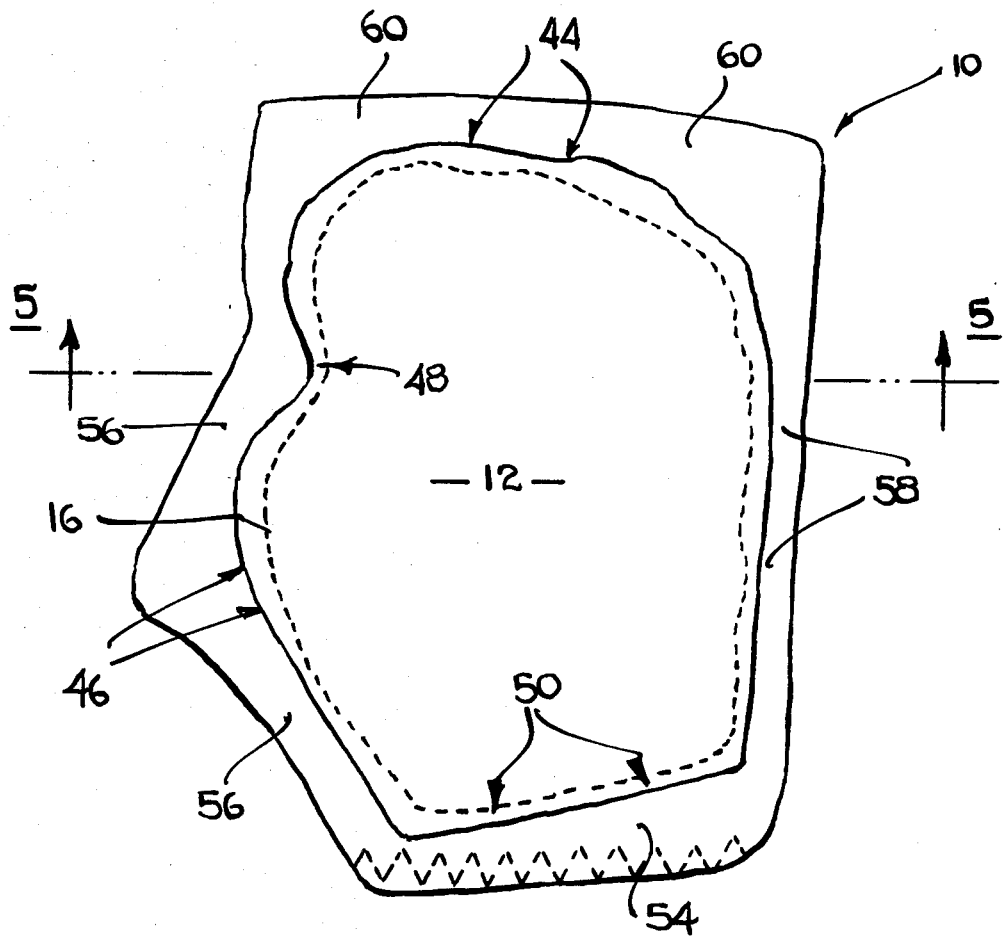
FIG. 4 is a view of the right hand glove of FIG. 1 which has been turned inside-out, showing the portion of the glove which directly contacts the entire underside of the hand.
Figure 5:
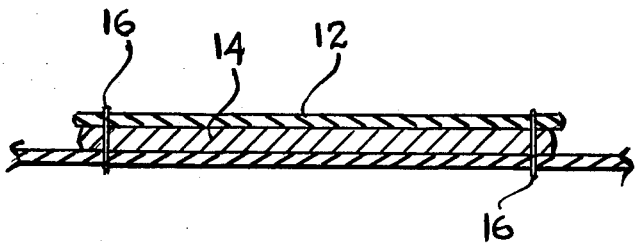
FIG. 5 is a cross-sectional view taken along the line 5—5 in FIG. 4 showing the structural details of the presently preferred lamination of the built-in cushioning.

Referring to FIGS. 1 and 2 in the context of the hand parts as designated on FIG. 3, the invention is designed to cover the entire central portion of the palm 20, but the cushion layer 14 has a decreased area and decreased diameters as compared to the external cover 10 so that the cushion layer has outer perimeter edges which are displaced from the basal finger creases 21, the basal thumb crease 24, and the basal wrist crease 26. In other words, when the hand (and its fingers and thumb) is in a gripping position as in FIG. 2, the entire composite formed by the external cover 10, the internal cover 12, and the cushion layer 14 will bend along the heart line 28, the head line 30 and the lifeline 32, while only the external cover member 10 will bend at the aforementioned creases 21, 24 and 26.

As an additional feature of the invention, it was found desirable to shape the perimeter of the cushion layer 14 in a way to cover as much as possible of the thumb pad 74, the interdigital finger pads 36 and the heel 38 in order to shield and insulate them from stress and/or abrasion without interfering with the movement of the hand. In that regard, the cushion layer 14 was found to work best when it was sized and shaped to have a convex top edge 44 when viewed from the vantage point of the fingers, a convex side edge 46 adjacent the basal thumb crease 24 when viewed from the vantage point of the thumb, and to have a marginal indentation 48 on its side edge immediately adjacent to the anatomical snuff-box portion 40 of the hand. The cushion layer 14 was designed with a substantially straight line margin 48 along the edge adjacent the basal wrist crease 26.

In order to securely position the cushion layer 14, the internal cover member 12 is sized and shaped to have at least the same cross-sectional area as the cushion layer, although it could conceivably be larger if it were desirable to have the internal cover member substantially overlap the edge of the cushion layer.

It is important to emphasize that the underside portion of the hand protected by the laminated cushioning of the invention contains many vital nerves and related connective tissues which have not been adequately protected by most snugly fitting gloves which have been used in the past.

In order to avoid undue bulkiness while at the same time still providing sufficient coverage over most of the underside of the hand, both the cushion layer and the internal cover have outer boundary margins which are displaced from the outer boundary of the external cover, thus leaving a peripheral band of a single layer of material along the wrist border 54, the thumb border 56, the opposite border 58, and the finger border 60. The attachment 16 which holds the laminated three-ply glove wall in position is any suitable adhesive or stitching—in the preferred embodiment a single high strength stitch is provided around the entire peripheral margin, although double stitching or other reinforcement could be employed. It was found preferable to leave the central portions of the composite three layer wall free of any stitching in order to allow for relative movement of the three layers when the hand is flexed back and forth between the open position and the gripping position.

In view of all the foregoing, it will be understood that the improved glove of the present invention provides a single surface of material for frictional engagement with the bat or other object to be gripped while at the same time providing interference-free cushioning over the vital parts of the underside of the hand in a way which enables the glove to be used for many purposes such as during batting, base-running, as well as inside an overstuffed mitt used during fielding.

While an exemplary embodiment has been shown and described, the invention is not limited to the specific details thereof, but covers various revisions, changes, modifications, and equivalent structures, all within the scope and spirit of the invention as set forth in the following claims.

I claim as my invention:

1. A glove for wearing by participants in athletic events to protect the underside of the hand in both the gripping position and in the open position without interfering with the flexing of the thumb and fingers, including:

first leather-like sheet means constituting an external cover member shaped for snugly overlying the entire underside of the hand from the wrist crease line below the heel of the hand up to the basal thumb crease line and the basal finger crease lines;

cushion layer means located inside of said first sheet means and having a cross-sectional area and corresponding diameters which are both less than said first sheet means, said cushion layer means having a normal thickness of between approximately $\frac{1}{4}$ inch and $\frac{1}{8}$ inch throughout its entires area for insulating against direct and indirect impact stresses received through said external cover member;

second leather-like sheet means constituting an internal cover member having a cross-sectional area and perimeter shape approximately identical to said cushion layer means; and wherein said cushion layer means and said internal cover member constitute a composite member sized and shaped to completely cover the central portion of the palm of the hand and to partially cover the ball of the thumb and the interdigital pads opposite the basal finger knuckles in order to leave the basal thumb crease line and the basal finger crease lines displaced from said cushion layer means when the hand is in the open position, said composite member being sized and shaped to have a convex top edge when viewed from the vantage point of the fingers, a convex side edge adjacent the basal thumb crease line when viewed from the vantage point of the thumb, and to have a marginal indentation on its side edge immediately adjacent to the anatomical snuffbox portion of the hand, thereby allowing said external cover member to fold with only minimal bunching along the base of the thumb and fingers when the hand is in the gripping position; and attachment means located along the peripheral border of said composite member for connecting said internal cover member to said external cover member with said cushion layer means sandwiched therebetween, and wherein said attachment means passes through and interconnects each of said external cover member, said cushion layer means, and said internal cover member.

2. The glove of claim 1 wherein said attachment means is located only along the peripheral border of said composite member leaving the central portions of said external cover member, said cushion layer means, and said internal cover member free for relative movement with each other when the hand is moved back and forth between the gripping position and the open position.

3. The glove of claim 1 wherein said composite member is sized and shaped to partially cover the heel of the hand in order to leave the wrist crease line displaced from said cushion layer means when the hand is in the open position, thereby allowing said external cover member to fold with only minimal bunching along the wrist joint without interfering with the flexing of the hand.

4. The glove of claim 1 wherein said composite member is sized and shaped to have diameters which each measure less than the corresponding diameters of said external cover member in order to have a peripheral band constituting only said external cover member around the marginal borders of the underside of the hand.

* * * * *